United States Patent [19]

Dreesen et al.

[11] 4,139,195

[45] Feb. 13, 1979

[54] AUTOMATIC POWDER DISPENSER FOR TENNIS RACKET HANDLES AND THE LIKE

[76] Inventors: William R. Dreesen; Lillian Dreesen, both of FF-10, Vista Pines 2600 SE. Ocean Blvd., Stuart, Fla. 33494

[21] Appl. No.: 727,286

[22] Filed: Sep. 27, 1976

[51] Int. Cl.[2] ..... A63B 49/08

[52] U.S. Cl. ..... 273/75

[58] Field of Search ..... 273/68, 72 R, 73 R, 273/73 J, 75, 81 R, 162 R, 162 F, 17–19; 43/23; 124/45; 34/80, 81; 222/468, 478–489, 564, 565

[56] References Cited

U.S. PATENT DOCUMENTS

| | | | |
|---|---|---|---|
| 1,045,071 | 11/1912 | Oldenbusch | 273/73 J X |
| 1,487,973 | 3/1924 | Preston | 124/45 X |
| 1,563,352 | 12/1925 | Fisher | 273/73 J |
| 2,758,592 | 8/1956 | Phipps | 43/23 X |
| 3,152,732 | 10/1964 | Schulman et al. | 222/485 X |
| 3,645,008 | 2/1972 | Delsack | 273/73 J X |
| 3,963,237 | 6/1976 | Bushberger | 273/19 |

FOREIGN PATENT DOCUMENTS

| | | | |
|---|---|---|---|
| 22303 of | 1898 | United Kingdom | 273/81 R |

*Primary Examiner*—Richard J. Apley

*Attorney, Agent, or Firm*—Woodard, Weikart, Emhardt & Naughton

[57] ABSTRACT

An automatic powder dispenser for the handles of tennis rackets and the like is disclosed herein which comprises a chamber within the handle and several passageways which connect the chamber with the exterior of the handle. A relatively fine powder of rosin, corn starch, magnesium carbonate, and similar materials is contained within a foraminous cartridge located within the chamber. The particle size of the powder material is less than the size of the openings in the foraminous cartridge and the passageways connecting the chamber to the exterior of the handle. Movement of the handle will therefore result in the powder being dispensed by the cartridge to the chamber and through the connecting passageways to the exterior of the handle. A cap or similar closure is removably received in an exterior opening in said chamber to permit the cartridge to be removed from the chamber. A cylinder having apertures located in the same pattern as the pattern of the passageways at the chamber wall may be included to fit snugly against the interior wall of the chamber. Rotation of the cylinder relative the interior wall of the chamber thereby provides a means for closing the passageways at this location to prevent the powder from being dispensed through the apertures.

13 Claims, 7 Drawing Figures

AUTOMATIC POWDER DISPENSER FOR TENNIS RACKET HANDLES AND THE LIKE

BACKGROUND OF THE INVENTION

1. Field of the Invention

This invention relates to the field of articles such as sporting accessories, tools, and similar items which include a handle portion, and more particularly relates to the provision of an automatic powder dispenser for depositing powder against the hand of the user of the item during the time that the hand is grasping the handle portion.

2. Description of the Prior Art

There is a large variety of articles and devices which include a handle portion intended to be grasped by a hand when the article is in use. In many circumstances, perspiration from the user's hand will wet the surface of the handle portion and will interfere with the use of the article. A tennis racket, for example, includes a handle portion which must be firmly grasped by the user in order to exert maximum control over the racket. The normal use of a tennis racket will lead to perspiration from the user's hand being transferred onto the handle portion, and this will generally lead to a decrease in both comfort and control. A similar problem may frequently be encountered when using such other items as carpentry tools, medical instruments, steering wheels, and a wide variety of other articles which include handle portions.

In order to overcome the difficulties involved with the handle portion of an article becoming wet from perspiration during use, various approaches have been employed. Tennis rackets, for example, are frequently covered with a porous material in order to divert the perspiration from the surface of the handle, or with a terry cloth or other absorbent material in order to absorb a portion of the perspiration. In U.S. Pat. No. 3,614,100, issued to Spitz on Oct. 19, 1971, there is disclosed a removable sleeve for a racket handle which includes an absorbent, such as terry cloth, surrounding a tubular elastic liner which frictionally engages the handle. A variety of other special wrappings or sleeves have been advised and operate in a similar manner. These modifications, however, interfere with the natural feel of the handle.

A different approach which has proved successful to some degree is disclosed in U.S. Pat. No. 3,645,008, issued to Delsack on Feb. 29, 1972. The Delsack patent discloses the use of a pelletized desiccant held within a chamber located in the interior of the handle portion. A network of grooves and passageways serves to direct the perspiration inwardly to the desiccant by which it is adsorbed. The Delsack device, however, does not operate to dry the user's hand or the surface of the handle portion, but instead adsorbs that portion of the perspiration which manages to move inwardly from the handle surface.

Yet another approach is described in U.S. Pat. No. 1,563,352, issued to Fisher on Dec. 1, 1925. The Fisher device entails a chamber within a handle and an opening which communicates from the chamber to the exterior of the handle portion. A cap which normally covers the opening at the handle surface may be removed from the opening and a powder held within the chamber may be physically shaken out through the opening. The Fisher device, however, does not provide for the automatic dispensing of the powder from the chamber, but instead provides only a convenient receptacle for the powder.

SUMMARY OF THE INVENTION

In an article having a handle portion adapted to be grasped by a hand, the improvement comprising a chamber within the handle portion, a foraminous cartridge having an interior and an exterior and being contained within the chamber, the cartridge having several holes extending between and communicating with the interior and exterior of the cartridge, particles of powdered material contained within the cartridge, the size of the particles being smaller than the size of the holes in the cartridge to permit the particles to pass through the holes from the interior of the cartridge, and passageways communicating with the chamber and with the exterior of the handle portion and having a size greater than the size of the particles to permit the particles to pass therethrough from the chamber to the exterior of the handle portion.

It is an object of the present invention to provide an automatic powder dispenser for the handle portion of a tennis racket or similar article which dispenses powder to the surface of the handle portion to assist the user in maintaining a dry grip.

A further object of the present invention is to provide a powder dispenser of the above-described type which does not disturb the natural feel of the handle portion of which it is a part.

It is a further object of the present invention to provide an automatic powder dispenser which is capable of dispensing upon the hand engaging the handle portion of an article a powder which may serve several functions, such as drying the handle, soothing the user's hand, and others.

Further objects and advantages of the present invention will become apparent from the figures and description which follow.

DESCRIPTION OF THE PREFERRED EMBODIMENTS

Figure 1:
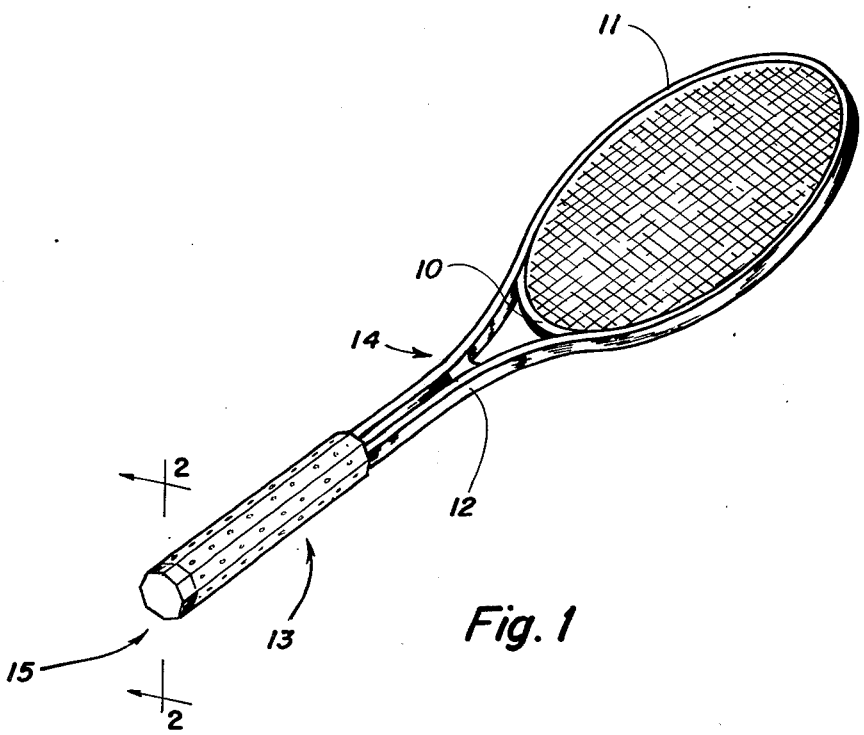
FIG. 1 is a perspective view of a tennis racket incorporating the automatic powder dispenser of the present invention in the handle portion thereof.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the figures, there is shown a tennis racket 10 having a head portion 11 and a handle portion 12, the handle portion incorporating the automatic powder dispenser 13 of the present invention. While the dispenser 13 according to the present invention will be described in conjunction with the handle portion of a tennis racket, it should be understood that the inventive concepts are not limited to the field of tennis rackets or rackets in general, but that the description is by way of illustration only. The dispenser 13 may readily be adapted to use with the handle portions of a variety of other articles, as previously discussed, and the objects and advantages of the dispenser will also be realized. The preferred embodiment of the dispenser, however, is directed at the provision of a tennis or similar racket with a handle portion which automatically dispenses powder onto the user's hands. The dispenser works particularly well in conjunction with articles such as a tennis racket since the dispensing of the powder will be enhanced by the impact of the racket upon a tennis ball.

Handle portion 12 has one end 14 attached to an article such as the head portion 11 of a tennis racket, and further includes a spaced free end 15. Handle portion 12 comprises an elongated member 16 which includes a chamber defined by a central bore 17 extending therethrough and communicating with end 15. Cylinder 18 lines the chamber or central bore 17 of member 16 and includes several radially extending holes 19. Aligned with the holes 19 are cup-shaped openings 20 which extend radially from bore 17 and which communicate with the exterior 21 of member 16. Holes 19 and complementary cup-shaped holes 20 thereby form a plurality of passageways extending from central bore or chamber 17 to exterior 21.

Contained within chamber 17 is a foraminous cartridge 22. Cartridge 22 includes several apertures 23 which extend therethrough, thereby connecting the interior 24 to chamber 17. Cartridge 22 is sized to fit somewhat loosely within chamber 17 to permit relative movement therebetween. This loose fit is not necessary, however, since apertures 23 could simply be aligned with holes 19 in cylinder 18. A powder 25 having the composition desired to be dispensed is contained within cartridge 22. The particle sizes of powder 25 are sufficiently small to permit passage of the particles through apertures 23. By this construction, therefore, the particles of powder 25 may pass from interior 24 of cartridge 22, through apertures 23 and into chamber 17, then through holes 19 and 20 to the exterior 21 of member 16. Handle portion 12 may also be wrapped with a material to provide comfort to the user, and this wrap 26 is then provided with holes 27 to permit the powder 25 to pass through holes 20 and 27 to the user's hands.

Figure 4:
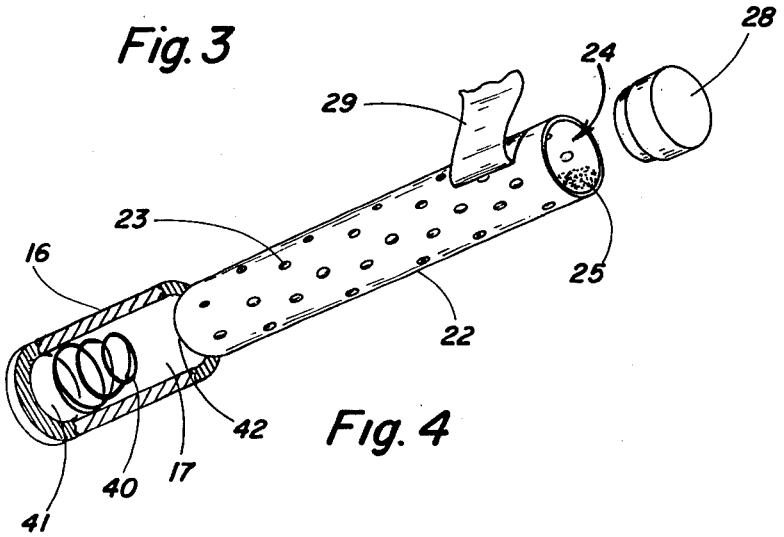
FIG. 4 is an exploded, perspective view of an embodiment of the powder cartridge and handle portion utilized by the present invention.
Figure 5:
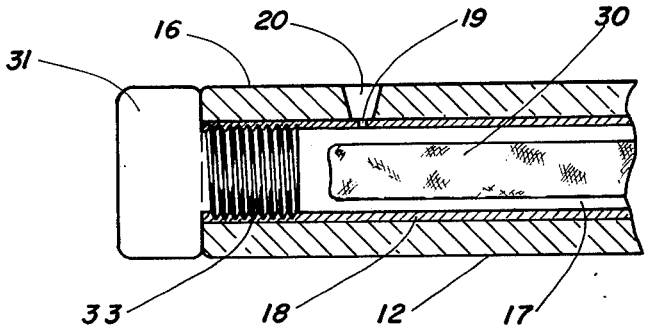
FIG. 5 is a side, cross-sectional view of an embodiment of the automatic powder dispenser of the present invention, showing alternate forms of the cap and powder cartridge.

In FIGS. 4 and 5, there is shown two alternate embodiments for the powder-containing cartridge utilized by the present invention. Cartridge 22 (FIG. 4) corresponds to the embodiment of the cartridge depicted in FIG. 2. As previously described, cartridge 22 includes apertures 23 which extend therethrough to permit the particles of powder 25 to pass from the interior 24 of cartridge 22 to chamber 17. Cartridge 22 may be formed of any material which will not fail under the conditions of use of the article having the handle portion in which it is inserted. Where considerable impact will be felt by the handle portion, as in the case of a tennis racket handle, then cartridge 22 is preferably formed from a relatively strong plastic material. Cartridge 22 also preferably includes an open end adapted to receive a closure cap 28 (FIG. 4) which may be removed to permit the supply of powder within cartridge 22 to be replenished. Any suitable closure means which permits powder to be charged to the cartridge 22 may be employed. A simple cap 28, which may be secured as by threads or frictional fit, is preferred since the construction thereof is simple and not expensive.

Cartridge 22 may also include tape 29 or similar means for closing off some or all of apertures 23. It may be convenient to have all of the apertures 23 closed when cartridge 22 is sold. It may also be advantageous to have some of apertures 23 close during use, this providing one means for controlling the amount of powder which is dispensed. The use of tape 29 provides a simple and inexpensive way for closing apertures 23, and also for selectively closing only a portion of apertures 23.

In an alternate embodiment, powder 25 may be contained within a cloth cartridge 30 (FIG. 5) similar to a rosin bag. The spaces which naturally occur in the cloth correspond to the apertures 23 which are provided in cartridge 22. In either embodiment, the maximum rate at which powder can leave the cartridge may be easily either by selecting the size and number of apertures 23 for cartridge 22, or by selecting the density of the material from which cloth cartridge 30 is formed.

Figure 2:
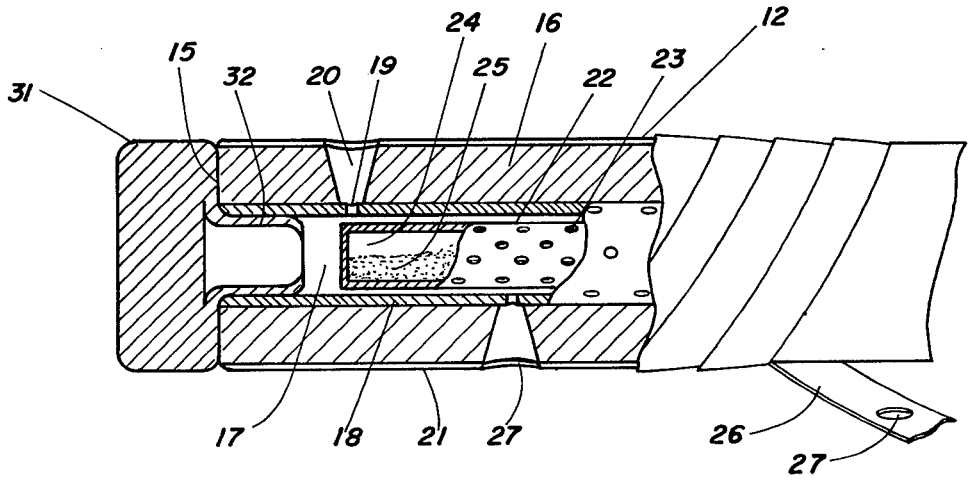
FIG. 2 is a side view of the handle portion of the tennis racket of FIG. 1 with portions broken away to show the details of the automatic powder dispenser of the present invention.
Figure 3:
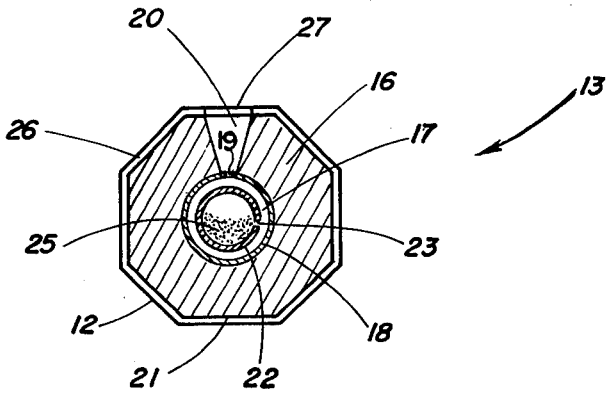
FIG. 3 is a cross-sectional view of the handle portion taken along the line 3—3 in FIG. 2 in the direction of the arrows.

Chamber 17 preferably comprises a bore within member 16 and extends centrally thereof. The powder-containing cartridge is held within chamber 17 by a removable cap 31 (FIG. 2). Cap 31 is preferably sized to have a shape which is complementary with the shape of handle portion 12. Cap 31 includes a portion 32 which extends within chamber 17 and is engaged thereby. This engagement may be by a frictional fit with the interior wall of cylinder 18. The method of attachment of cap 31, however, may be by a variety of known ways. For example, cap 31 may include a threaded portion 33 (FIG. 5) which is received by internal threads formed in either cylinder 18 or member 16. Other methods of attachment could also be utilized as by having a cap hinged to the end 15 of handle portion 12, or by having a cap slidably received within channels which permit the cap to be slid away from the position closing chamber 17. The only requirement with respect to a closure for chamber 17 is that it provide a means for retaining the powder-containing cartridge within chamber 17 during the use of the particular article of which handle portion 12 forms a part. Cartridge 22 could even include a portion which engages member 16 or cylinder 18 to cause it to be retained within chamber 17.

Figure 6:
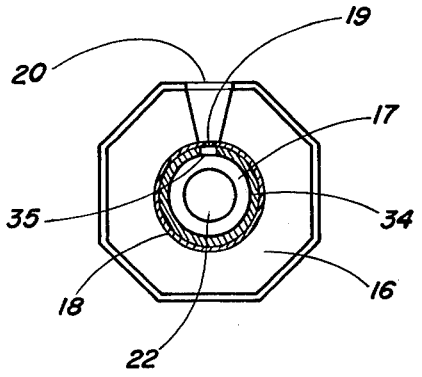
FIG. 6 is a cross-sectional view of an alternate embodiment of the present invention, showing a means for closing the passageways between the chamber and the exterior of the handle portion.
Figure 7:
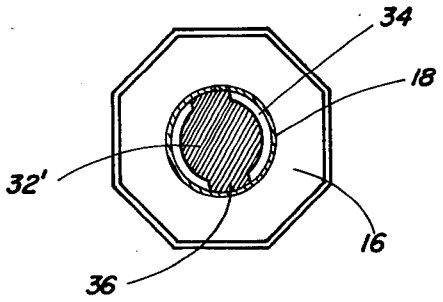
FIG. 7 is an end view of the alternate embodiment of the automatic powder dispenser of the present invention shown in FIG. 6, with the head of the cap removed to show a means for rotating the interior cylinder to close the apertures between the chamber and the handle exterior.

In FIGS. 6 and 7, there is shown a means for closing the passageways which consist of the aligned holes 19 and 20. A cylinder 34 is positioned within cylinder 18. Cylinder 34 includes holes 35 which are arranged in the same configuration as are holes 19. Holes 35 are slightly larger than holes 19. The communication of holes 19 and chamber 17 may therefore be blocked by rotation of cylinder 34 relative cylinder 18, moving holes 35 out of alignment with holes 19. A preferred means for accomplishing the rotation of cylinder 34 is depicted in FIG. 7. Cap 32' (the portion which extends outside of member 16 having been removed for the purpose of illustration) includes projections 36 which are received within complementary voids in cylinder 34. Rotation of cap 32' therefore causes projections 36 to engage cylinder 34 and results in the rotation of cylinder 34 relative cylinder 18. By causing this relative rotation, the pathway for powder 25 to the exterior of the handle portion is blocked, and powder will be prevented from being dispensed. For powder to again be dispensed, the cap 32' is simply rotated further until holes 35 and 19 are in alignment. It will be appreciated, however, that other known techniques for simultaneously closing a plurality of holes may be adapted to the automatic powder dispenser of the present invention, herein having been described a preferred embodiment for accomplishing this purpose.

The powder 25 utilized by the present invention may comprise a variety of materials. A primary constituent of powder 25 would be a desiccant which would provide for the adsorption of moisture at the exterior surface of the handle portion. Other materials which would assist the user's grip or provide a soothant or medicament for the user's hand could also be advantageously included. A variety of materials which would fulfill these various purposes are known. A preferred embodiment for the powder material is a mixture of rosin, corn starch, magnesium carbonate and alumina hydrate.

A preferred application for the automatic powder dispenser of the present invention is in conjunction with a tennis racket or a similar article such as a squash or racquetball racket. In these and other articles, the dispensing action is enhanced by the continuous motion of the article and by the impact of the article against another object. In order to maintain the structural strength of the handle, it is preferred that the chamber extend only a sufficient distance along the handle portion to ensure that powder will be dispensed at the point at which a handle is likely to grasp the handle portion. The dispenser of the present invention has as major advantages the minimal interference with both the strength and the feel and appearance of the handle portion of an article. These are important factors in providing an automatic powder dispenser for certain items, particularly for sport rackets.

As shown in FIG. 4, a compression spring 40 may be included within chamber 17 and could either be attached to or simply rest against surface 41 at the end of chamber 17. Spring 40 serves two functions. First, it bears against end portion 42 of cartridge 22 to urge the cartridge out of chamber 17 when the closure cap is removed, thus facilitating removal of the cartridge for replacement or refilling. Further, the spring will prevent the cartridge from rattling or moving excessively within chamber 17 while the racket is in use.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

The invention claimed is:

1. In an article having a handle portion adapted to be grasped by a hand, the improvement comprising:

a chamber within the handle portion;

a foraminous cartridge having an interior and an exterior and being contained within said chamber, said cartridge having several holes extending between and communicating with the interior and exterior of the cartridge;

particles of powdered material contained within said cartridge, the size of said particles being smaller than the size of the holes in said cartridge to permit said particles to pass through the holes from the interior of said cartridge; and passageways communicating with said chamber with the exterior of the handle portion intermediate the ends of the article, said passageways being normally open and having a size greater than the size of said particles to permit said particles to pass therethrough from said chamber to the exterior of the handle portion, said passageways extending transverse of the handle axis.

2. The improvement of claim 1 in which said chamber includes an opening which communicates with the exterior of the handle portion, the opening being sized to permit removal of said cartridge therethrough and which further includes closure means for closing off the opening of said chamber to retain said cartridge within said chamber.

3. The improvement of claim 2 in which the handle portion comprises an elongated member having one end attached to the article and having a spaced free end, said chamber being defined by an elongated bore extending to and through the free end to define the opening in said handle portion.

4. The improvement of claim 3 in which said closure means comprises a cap having a portion which is frictionally engaged within the opening in the handle portion.

5. The improvement of claim 1 and which further includes means for closing off said passageways.

6. The improvement of claim 3 and which further includes means for closing off said passageways.

7. The improvement of claim 6 in which said passageway-closing means comprises a cylinder located within and adjacent the walls of the elongated bore defining said chamber, said cylinder having holes aligned with said passageways, said passageway-closing means further comprising means for rotating said cylinder relative to said chamber, whereby the holes in said cylinder may be moved into and out of alignment with the passageways.

8. The improvement of claim 1 in which each of said passageways comprises a cylindrical hole having one end in communication with said chamber and the other end in communication with a cup-shaped opening which extends generally radially to and through the exterior of the handle portion.

9. The improvement of claim 1 in which said cartridge is a cloth bag.

10. The improvement of claim 1 in which said cartridge includes an enlarged opening extending between and communicating with the interior and exterior of said cartridge, said cartridge further including closing means for closing said opening, whereby the supply of said particles may be replenished by pouring said particles through the enlarged opening.

11. The improvement of claim 10 in which said cartridge further includes tape means for covering a plurality of the holes in said cartridge.

12. The improvement of claim 1 in which the article is a racket.

13. The improvement of claim 1 and which further includes a compression spring located with said chamber and bearing against said cartridge.

* * * * *